US008770079B2

(12) United States Patent
Baba et al.

(10) Patent No.: US 8,770,079 B2
(45) Date of Patent: Jul. 8, 2014

(54) SHEET HOLE PUNCHING DEVICE

(75) Inventors: Kenji Baba, Kofu (JP); Yuji Hasebe, Minamialps (JP); Yoshinori Hoshino, Yokohama (JP)

(73) Assignee: Seiko Ltd., Kawasaki-shi (JP)

( * ) Notice: Subject to any disclaimer, the term of this patent is extended or adjusted under 35 U.S.C. 154(b) by 220 days.

(21) Appl. No.: 13/483,821

(22) Filed: May 30, 2012

(65) Prior Publication Data

US 2012/0297951 A1 Nov. 29, 2012

Related U.S. Application Data

(60) Continuation-in-part of application No. 12/923,464, filed on Sep. 23, 2010, now Pat. No. 8,291,802, which is a division of application No. 11/727,940, filed on Mar. 29, 2007, now Pat. No. 7,823,494.

(30) Foreign Application Priority Data

| | | |
|---|---|---|
| Mar. 31, 2006 | (JP) | 2006-100253 |
| Aug. 3, 2006 | (JP) | 2006-212535 |
| Jan. 15, 2007 | (JP) | 2007-005512 |
| Jan. 30, 2007 | (JP) | 2007-019457 |
| Mar. 9, 2007 | (JP) | 2007-060841 |

(51) Int. Cl.
*B26F 1/04* (2006.01)

(52) U.S. Cl.
CPC ..... *B26F 1/04* (2013.01)
USPC ..... 83/618; 83/628; 83/687; 234/94; 408/153

(58) Field of Classification Search
USPC ..... 83/618, 627–629, 631, 632, 684, 686, 83/687, 691; 234/43, 94, 97, 98, 101; 408/87, 153
See application file for complete search history.

(56) References Cited

U.S. PATENT DOCUMENTS

| | | | | | |
|---|---|---|---|---|---|
| 443,766 | A | * | 12/1890 | Moran | 408/87 |
| 1,345,395 | A | * | 7/1920 | Packheiser | 83/631 |
| 1,421,928 | A | * | 7/1922 | Fitzgerald | 408/136 |
| 1,747,240 | A | * | 2/1930 | Haupt | 83/354 |
| 2,528,282 | A | * | 10/1950 | Melberg | 83/105 |
| 5,676,497 | A | * | 10/1997 | Kim | 408/21 |
| 6,540,451 | B1 | * | 4/2003 | Mori | 83/629 |
| 6,622,908 | B2 | * | 9/2003 | Fukumoto et al. | 234/98 |
| 6,751,874 | B2 | * | 6/2004 | Eldar | 30/363 |

(Continued)

FOREIGN PATENT DOCUMENTS

| | | | |
|---|---|---|---|
| JP | 2002-326196 | A | 11/2002 |
| JP | 2008137099 | A * | 6/2008 |

*Primary Examiner* — Stephen Choi
(74) *Attorney, Agent, or Firm* — Manabu Kanesaka

(57) ABSTRACT

A sheet hole punching device has a device frame; a plurality of punching members arranged in first and second groups, and arranged linearly on the device frame; a driving rotation shaft; a driving motor reciprocally rotating the driving rotation shaft; a gear mechanism transmitting a rotation of the driving rotation shaft; cam mechanisms converting the rotational movement; and a motor control device. The gearing mechanism includes drive gears disposed on the drive rotational shaft, and receiving gears disposed on the punching members to engage with the drive gears. The cam mechanisms include cam followers and cylindrical cams. The cylindrical cam has a V-shaped groove cam to reciprocate each of the punching members between an upper dead point and a lower dead point. The punching members are rotated in one direction to punch holes in first sheets, and subsequently rotated in a reverse direction to punch holes in following sheets.

7 Claims, 13 Drawing Sheets

(56) References Cited

U.S. PATENT DOCUMENTS 6,860,478 B2 * 3/2005 Hirai ..... 83/370
7,458,505 B2 * 12/2008 Majima et al. ..... 234/98
2001/0011492 A1 * 8/2001 Fukumoto et al. ..... 83/549

* cited by examiner

SHEET HOLE PUNCHING DEVICE

CROSS-REFERENCE TO RELATED APPLICATIONS

The present application is a continuation-in-part application of Ser. No. 12/923,464, filed on Sep. 23, 2010, which is a divisional application of Ser. No. 11/727,940, now U.S. Pat. No. 7,823,494.

BACKGROUND OF THE INVENTION

1. Field of the Invention

The present invention relates to a h hole punching device used in conjunction with image forming apparatus, that punch holes in sheets conveyed out from an image forming apparatus such as a copier, printing machine or printer and the like.

2. Description of Related Arts

Generally, hole-punching devices that punch holes in sheets by manually pushing hole-punching members downward into a plurality of sheets, and automatic hole-punching devices that punch holes in sheets conveyed out of a printing machine or copier are well known as office devices for punching holes in sheets, such as paper, for filing. The former is widely known as a device for penetrating sheets by disposing cylindrically shaped punching members that reciprocatingly move up and down, on a frame member that sandwiches sheets. By pressing an operating lever downward, these cylindrically shaped hole-punching members penetrate the sheets thereby punching holes.

On the other hand, the latter method uses a drive motor to push punch members through sequentially conveyed out sheets that are set at a predetermined position. These are often incorporated into other devices. Both types of hole-punching devices can simultaneously punch holes in sheets at 2, 3, and 4 positions of predetermined distances. The number of holes and the distances therebetween are set to a uniform standard.

Conventional devices are disclosed in Japanese Pat. Pub. 2001-9791, 2001-26370, 2000-301492, and 2002-36196. These publications disclose disposing an upper frame and a lower frame at a predetermined distance to sandwich sheets set therebetween. The upper frame supports a plurality of hole-punching members to move in up and down directions; the lower frame is formed with die punches (blade-bearing holes) that conform to the hole-punching members. A device is disclosed that uses a drive motor to move a plurality of hole-punch members in a hole-punching direction to punch holes in predetermined position of sheets. Depending on the standard, the plurality of hole-punching members can be selectively operated to punch two, three or four holes. Also, the load torque applied to the drive motor is reduced by delaying the operation of the selected plurality of punch members.

For that reason, each of the plurality of punch members is connected to the drive motor via cam means. The Japanese Pat. Pub. 1 engages a follower pin equipped on each of the punch members with a sliding cam having an upside-down V-shaped cam groove. The sliding cam is supported to move along the upper frame. A drive motor pinion is connected to a gear rack integrally formed on a portion of the sliding cam. Japanese Pat. Pub. 2 discloses connecting an eccentric cam to each hole-punching member composed of the same configuration described above. This eccentric cam is installed on a drive shaft disposed parallel to the upper frame. The drive shaft is connected to a drive motor. The eccentric cam of each punch member selectively punches holes in sheets depending on the rotational angle of the drive shaft. At the same time, a time difference is provided to the operation of the selected plurality of punch members to vary the hole-punching timing.

These Japanese Patent publications disclose a structure where the hole-punching members punch holes in a sheet in the process of moving from a top dead center to a bottom dead center of a thrusting direction, by receiving thrusting force in the hole-punching direction from the V-shaped cam or eccentric cam without rotating around a longitudinal axis of rotation.

When selectively moving the plurality of hole-punching members in the hole-punching direction using cam means as described in the aforementioned Japanese Patent publications, the hole-punching members are moved up and down in the shaft direction by engaging a follower pin integrally formed in the punch members with a sliding cam as described in Japanese Patent Pub. 1. They are also moved up and down by connecting the punch members 40 shaft to an eccentric cam, as described in Japanese Patent Pub. 2. These conventional hole-punching structures have the problems outlined below because hole-punching members are normally formed into a spindle-shape to punch holes in a sheet (or sheet bundle) by a thrusting action that is simply an up and down action.

First, a die having blade-bearing holes is disposed sandwiching the sheets for the punch members that move up and down. A paper cutting debris box is equipped below the die to collect paper cutting debris generated by punching holes in the sheets. In this conventional hole punching device structure wherein punch members move in the up and down direction in only the thrusting direction, paper cutting debris accumulates directly below the blade bearing holes. If the volume of paper cutting debris increases, there is the possibility that the cuttings can find their way into the device through the blade bearing holes. Particularly, when operating the punch and paper cutting debris accumulates into a pile directly below the punch members, a higher load than what is required is applied to the hole-punching members and an excessive load is applied to the drive motor. These loads can lead to mechanical failure. Also, if paper cutting debris on the die gets inside the device, there is the problem of mis-operation of the sheet sensor inside the device.

Secondly, with the hole-punching structure that punches holes in sheets using the thrusting action in up and down directions, another load is placed on the drive motor because a high shear strength is required to punch holes in the sheets. For that reason, when punching holes in sheets such as plastic film, or thick sheets, there is a large load placed on the drive motor. This means that the device must either have a large-capacity motor, or a high gear reduction ratio is needed to punch holes at low speed. Therefore, such devices have the particular problems of requiring a large drive unit and higher costs associated with punching holes.

SUMMARY OF THE INVENTION

The present invention provides a hole-punching method and hole-punching device that can store large volumes of paper cutting debris without the paper cutting debris entering the device, and without increased loads on the hole-punching blades, when punching holes in sheets such as with punch members.

The present invention further provides a hole-punching device that can punch holes at high speed without reduced shear load when punching holes and at the same time can be configured with a compact and lightweight drive mechanism.

The above mentioned first problem is to punch holes in the sheets by moving the punching members in the punching direction as rotating them by reciprocal rotation of the drive motor. Then, this operation is accomplished by punching holes in the sheets continuous back and forth by reciprocally rotating the punch rotating directions alternately.

Thereby, paper cutting debris is scattered in all directions and is received in a paper cutting debris box. Therefore, the paper cutting debris neither accumulates into a pile directly below the punch members, nor enters the sheet surface from the punch holes and disperses within the device. Together with this, the paper cutting debris is scattered by reciprocal rotations of the punches, accumulated into the box and is not made full by less punching rotation number.

Further, the above mentioned second problem accomplishes reduction of punching load by moving the punching members (punching action) in the punching direction as rotating the punching members. The hole punching blades are then structured in inclination so that punching holes in the sheets continuous back and forth is reciprocally reversed. The life of the hole punching blades may be thereby lengthened.

The present invention is characterized by transmitting the rotation of the drive motor as the rotational motion from a driving rotation shaft to plural punching members, conversing the rotation of each of the punch members into motion in the punching direction at the same time as the rotation by means of the V-shape grooved cam provided between the device frames, executing, when reciprocating a driving rotation shaft within a predetermined angular range, the punching action reciprocating each of the punch members from an upper dead point to a lower dead point and subsequently from the lower dead point to the upper dead point by means of rotation in a going direction as well as rotation in a returning direction, and reversing, when continuously punching holes in the sheets, the rotating directions of the punch members by means of the foregoing and following sheets.

Further, the present invention is characterized by causing each of the punching members to execute hole punching, not integrally connected, but separated from the punching members the receiving gears of transmitting rotation thereto from the driving rotation shaft and cam members of displacing them in the hole punching direction.

The structure is to secure the cam members having V-shaped groove cams to a device frame, slidably engage each of the punching members with receiving gears in the hole punching direction, and engage the receiving gear with the drive gear to maintain the position of the hole punching direction.

DETAILED DESCRIPTION OF THE PREFERRED EMBODIMENT

Figure 1:
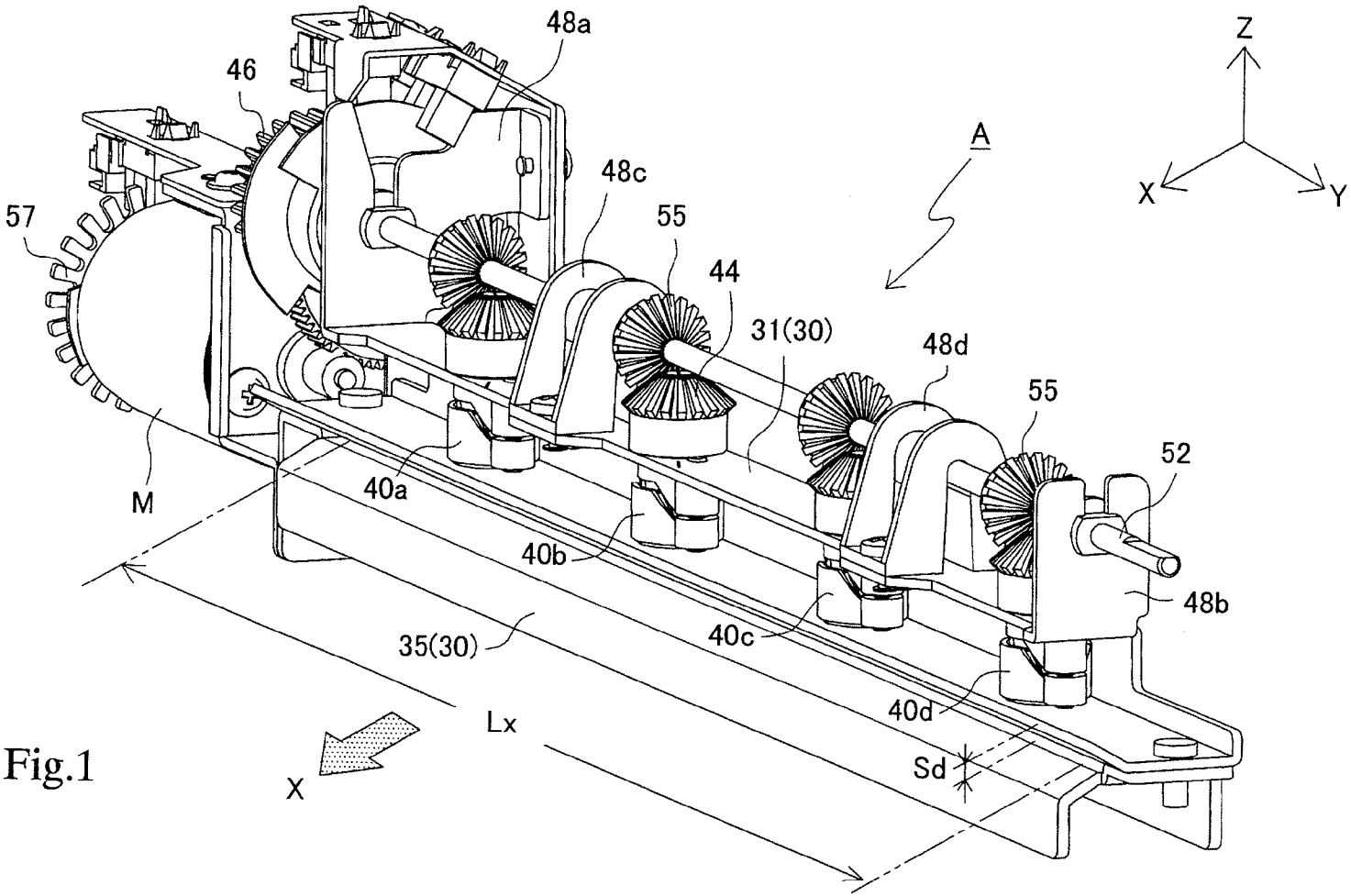
FIG. 1 is an explanatory and perspective view showing an entire structure of the hole punching device of paper sheets and the like relating to the present invention.
Figure 2:
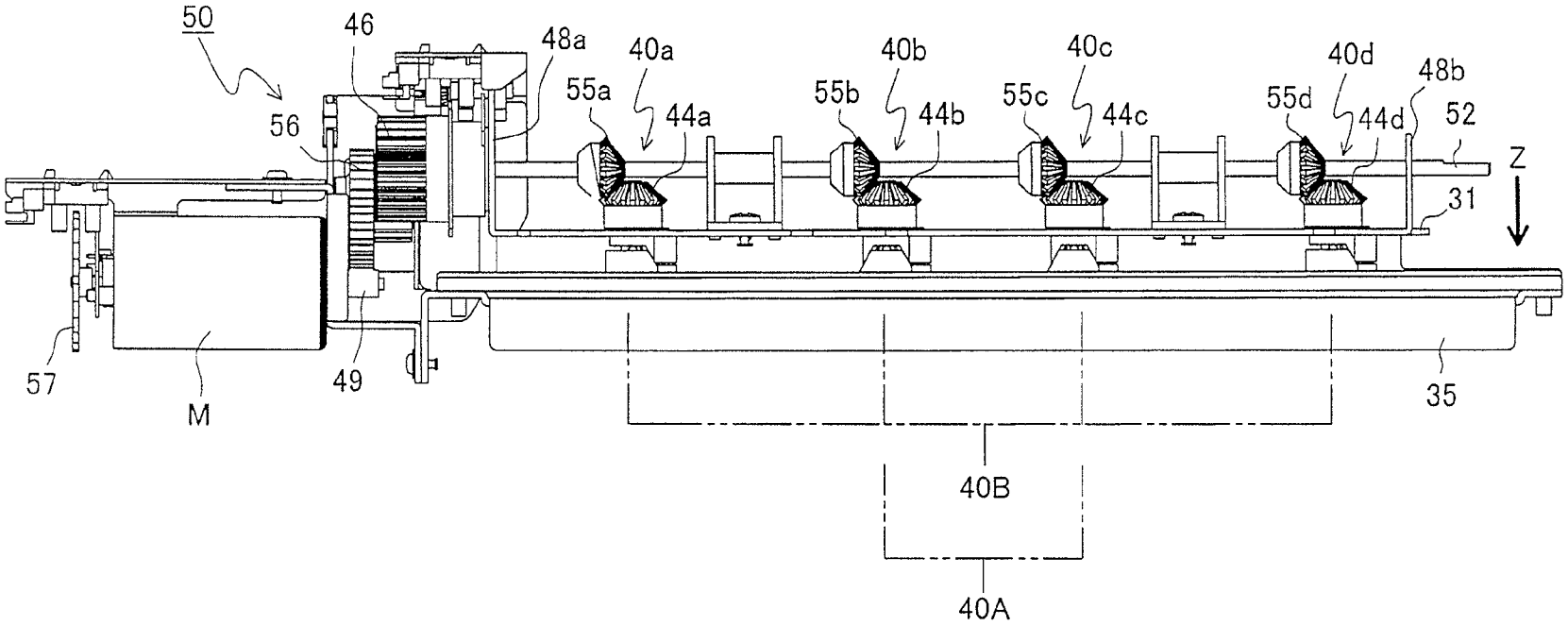
FIG. 2 is the explanatory view of a front structure in the device of FIG. 1.

The present invention will be referred to in detail based on shown preferred embodiments. FIG. 1 is the perspective view showing the whole structure of the hole punching device of paper sheets and the like relating to the present invention, and FIG. 2 is its front view.

The sheet hole punching device A shown in FIG. 1 is structured for punching 2 or 4 holes otherwise 2 or 3 holes selectively in the sheets. This sheet hole punching device A is composed of a device frame 30, punching members 40 and a drive means 50.

The device frame 30 is placed in a direction (Y direction) crossing with a sheet sending direction (X direction) and supports a plurality of the punching members 40 in the hole punching direction (Z direction) in a manner that the punching members can move in up and down directions. The punching members 40 are divided in a first group of punching members 40*b*, 40*c* (in the following, called generically as 40A) and a second group of punching members 40*a*, 40*b*, 40*c*, 40*d* (in the following, called generically as 40B), and they are disposed in a straight line on the device frame 30.

The driving means 50 vertically moves the plural punching members 40 respectively in the hole punching direction. Then, the drive means 50 of this invention transmits driving force to the punching members 40 in the rotation direction, and moves vertically the punching members 40 as rotating each of them by means of cam mechanisms arranged between the punching members and the device frame 30.

[Structure of Device Frame]

The structure of the device frame 30 will be explained following FIG. 1. The device frame 30 is composed of a base frame 31 having (mount support) plural punching members 40 and a sheet placing frame 35 holding sheets to be punched.

Between the base frame 31 and the sheet placing frame 35, a space Sd is formed for inserting the sheets, and lengths of both frames (length in width direction) are formed to be longer than length Lx in the sheet width direction (orthogonal direction in transportation).

Figure 3A:
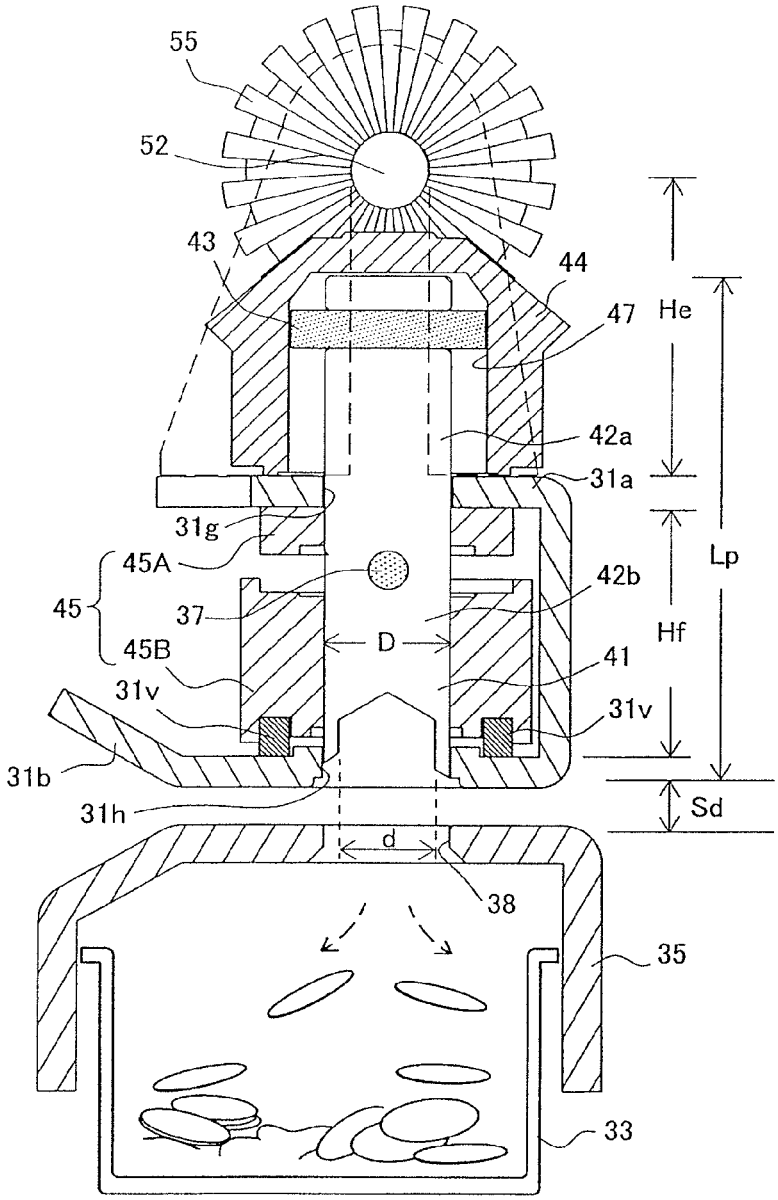
FIG. 3(*a*) is the explanatory view of a side and cross sectional state of the punching member shown in FIG. 2, and FIG. 3(*b*) is a cross sectional view of the upper part.
Figure 3B:
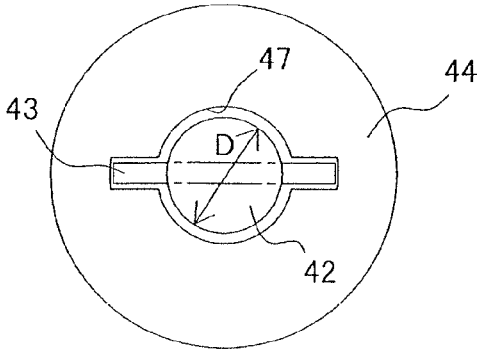

Taking an interval of the sheet inserting space Sd, there are disposed a base frame 31 at the upper part and a sheet placing frame 35 at the lower part. The base frame 31 is composed of an upper frame 31*a* having Hf in the hole punching direction Z (upper and lower directions in FIGS. 1 and 3(*a*)) and a lower frame 31*b*. The device is, as shown in FIG. 3, formed to be a channel shape, and supports each of the punching members 40, taking the interval Hf.

The base frame 31 of this invention is fabricated with a channel steel. The structure characterizes the invention, which has the plural punching members 40, a driving rotation shaft 52 moving vertically the punching members and strongly holding the driving motor M.

The sheet placing frame 35 is, as having mentioned above, provided with the dice (blade-bearing holes) 38, and the paper cutting debris drop downward due to hole punching action of the punching members 40. This sheet placing frame 35 is furnished with the debris boxes 33 into which the paper cutting debris is received.

At this time, in the hole punching mechanism not rotating the punching members 40 but vertically moving only in the hole punching direction, paper cutting debris accumulate directly below the dice 38.

Therefore, even if there still remains a space enabling to accommodate the debris within the debris box, they must be treated as being full so that paper cutting debris partially piling do not scatter within the device.

Since the present invention reversely rotates the punching members 40 and also a rotating direction each time of punching holes in the sheets, paper cutting debris dropping from the die holes 38 are scattered widely in right or left directions. Thus, the debris accommodating capacity of the debris box is made large.

In accordance with FIGS. 1 and 3(*a*), the structure of the punching member 40 will be explained. The punching members are divided into the first group of the punching members 40A and the second group of the punching members 40B, and each of the punching members has the same structure.

The punching members 40 are composed with rod shaped punching shafts 42 and hole punching 41 integrally formed at their front ends. The punching member 40 is shaped into the punching shaft 42 by using a metal material of a cylindrical shape of, for example, SK steel material or SUS steel material to turn out an outer configuration into a predetermined size (outer diameter D).

The punching shaft 42 is ground at its front end into the cylindrical shape (outer diameter D and inner diameter d) in order to form a hole punching. In this case, the outer diameter D of the punching shaft 42 and the outer diameter D of the hole punching blade 41 are formed to have the equal diameter in the illustration, but different sizes are enough.

The punching shaft 42 is slidably supported in a bearing hale 31*g* of an upper frame 31*a* shown in FIG. 3 and a bearing hale 31*h* of a lower frame 31*h*.

Further, each punching member 40 is provided at its front end with the hole punching blade 41. Its shapes are shown in FIGS. 5(*b*), 5(*c*) and 5(*d*). The hole punching blade 41 has a hollow cylindrical shape in cross section, and is pointed toward the front end, whereby when moving the punching member 40 in the punching direction, its front end punches the sheets.

At the same time, the hole punching blade 41 is formed to be inverse V-shaped (FIG. 5(*b*)), inverse U-shaped (FIG. 5(*c*)) or slanting shape (FIG. 5(*d*)).

The hole punching blade 41 serves both shearing force to the sheets in the hole punching direction and in the rotating direction when moving in the punching direction as rotating the punching members 40 in the hole punching direction.

The hole punching blade 41 is shaped to serve shearing force to the sheets in the hole punching direction and in the rotating direction when moving down in the punching direction as rotating the punching member 42 in the hole punching direction. The shapes of the blade points generating the shearing force in both directions are better to form as front keen as the V or U-shapes as explained in FIG. 5.

Next, a drive mechanism will be explained referring to FIG. 1.

The punching members 40 arranged in straight line are disposed with the driving rotation shaft 52 in the crossing direction with each of the punching members 40, and from this driving rotation shaft 52, rotating force is transmitted to each of the punching members 40. Therefore, the driving rotation shaft 52 is connected to a driving motor M via a reduction gear 46.

The control means 64 of the driving motor M rotates in any of left and right directions on the basis of a position (standard point; home position) having in advance furnished the drive motor M.

When rotating the driving rotation shaft 52 in one direction (for example, clockwise), the first group of the punching group 40A starts the hole punching operation, and when rotating in an opposite direction, the second group of the punching group 40B starts the hole punching operation.

Therefore, between each of the punching members 40 and the device frame 30, there are disposed the V-shaped groove cam 45C and cam projections (cam followers) 37 being in mesh with this groove cam.

As shown in FIG. 1, with respect to the plural punching members 40 arranged in straight line on the base frame 31, the driving rotation shaft 52 is disposed in the direction crossing with each of the punching members 40. The driving rotation shaft 52 transmits driving force to the punching members 40 during the hole punching operation.

In this invention, a rotating force is transmitted from the drive motor M to each of the punching members 40, so that each of the punching members 40 is moved vertically by means of cam mechanisms (later mentioned cylindrical cam 45 and cam projection 37) provided between each of the punching members 40 and the device frame 30. Accordingly, the punching members 40 move vertically in the hole punching direction while rotating.

The above mentioned base frame 31 is integrally provided with side frames 48*a*, 48*b* at its both sides. In the illustration, an upper frame 31*a* of the base frame 31 are formed with a right side frame 48*b* and a left side frame 48*a* bent in bracket shape, and these both side frames are supported in bearing with the driving rotation shaft 52.

Between the driving rotation shaft 52 and the upper frame 31*a*, a space He is defined, which has a size meeting the height of a later mentioned receiving gear (receiving side beveling gear) 44.

As shown in FIG. 3(*a*), the base frame 31 is provided the cylindrical cam 45 in an interval Hf between the upper frame 31*a* and the lower frame 31*b*, and the receiving gear 44 is disposed in an interval He between the upper frame 31*a* and the driving rotation shaft 52.

Thus, this invention is characterized by supporting the plural punching members 40 moving vertically with respect to the base frame 31 of the channel shape, and disposing the cylindrical cam 45 to the base frame 31 and the receiving gear 44 between the upper frame 31*a* and the driving rotation shaft 52.

[Cam Mechanism]

The cam mechanism will be explained following FIG. 4. The punching shaft 42 is provided on the outer periphery with the cylindrical cam 45 which is formed with the V-shaped groove cam 45C engaging with cam projections 37 of the punching shaft 42.

Figure 4:
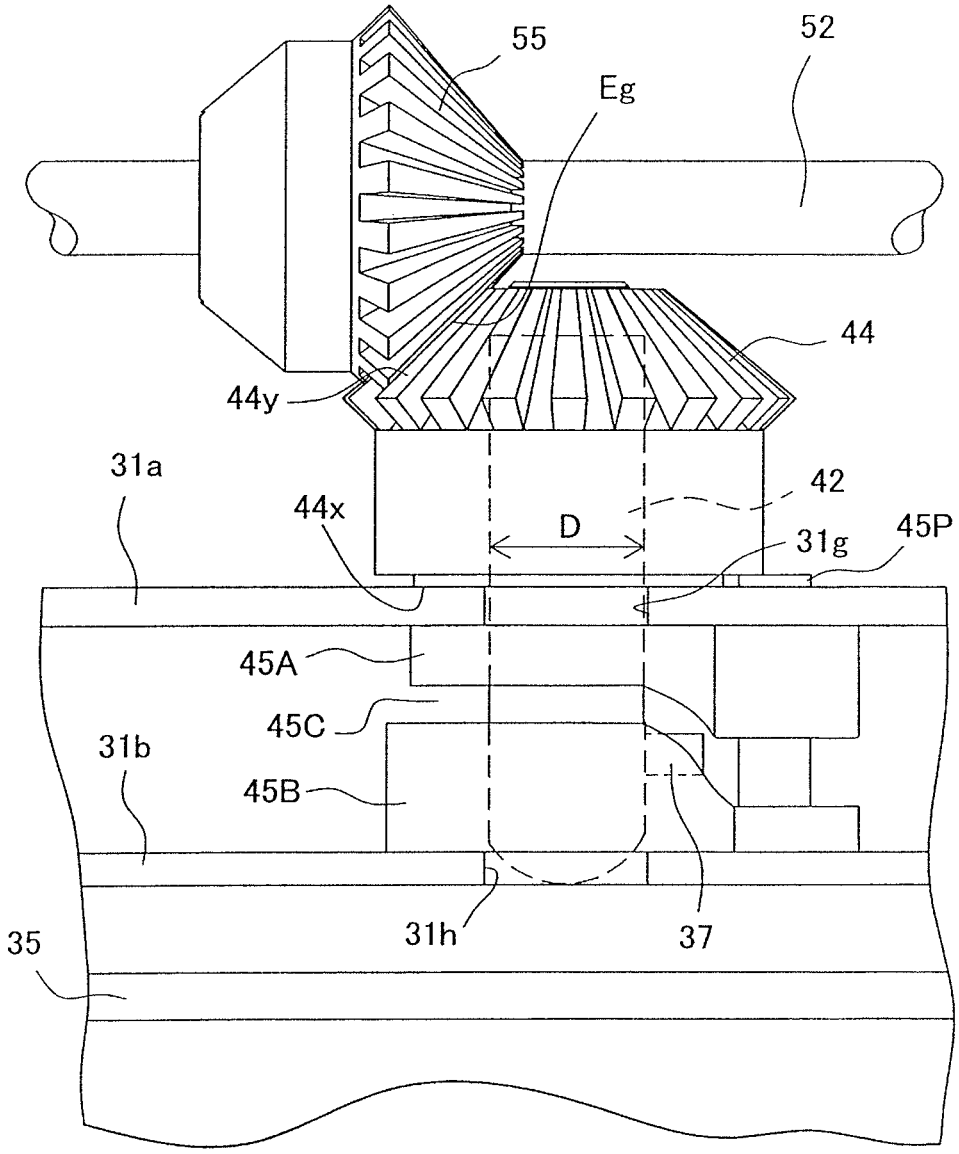
FIG. 4 is the explanatory view showing the punching member in the device of FIG. 1, attaching the punching member to a base frame.
Figure 5A:
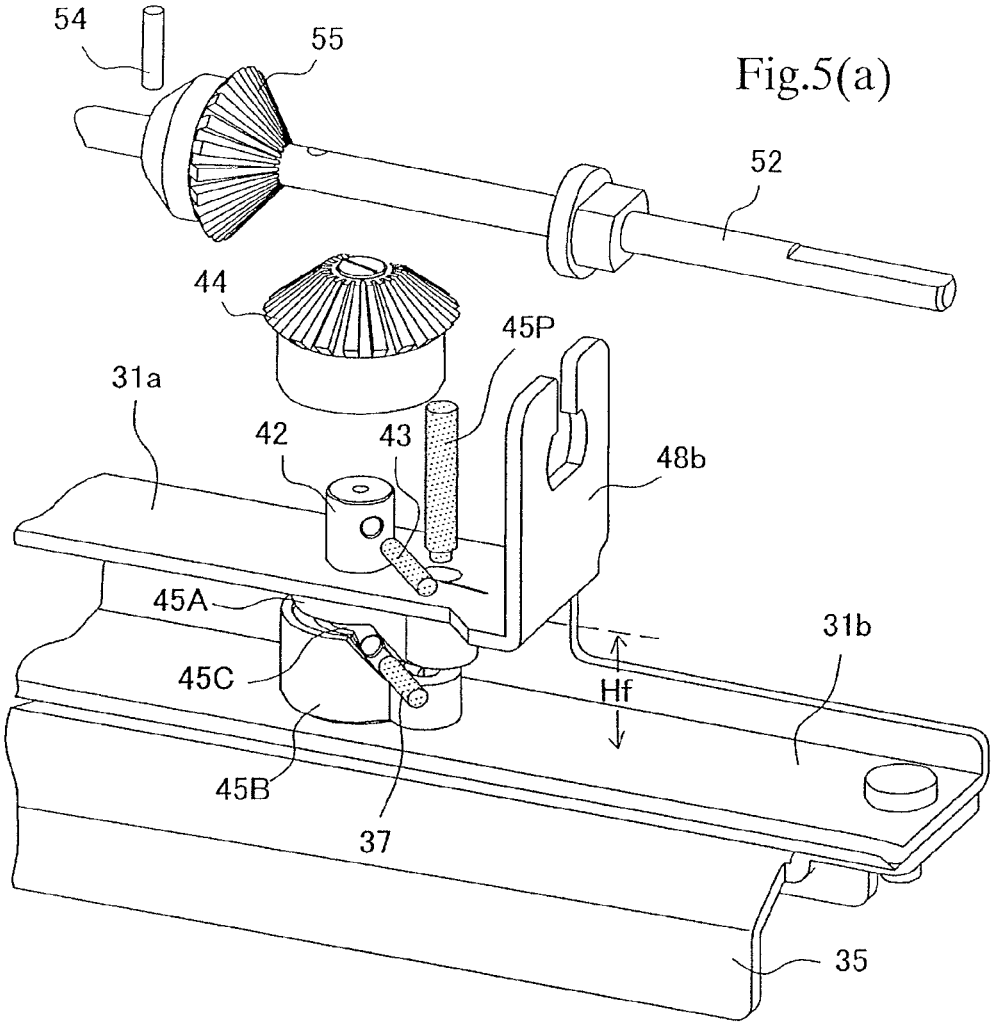
FIG. 5(*a*) is a disassembled perspective view of setting up the punching member in the device of FIG. 1, and FIGS. 5(*b*) to 5(*d*) showing embodiments of the edge points of the hole punching blades.
Figure 5B:
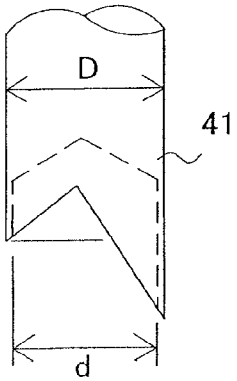
Figure 5C:
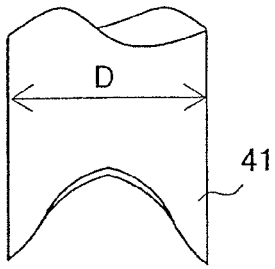
Figure 5D:
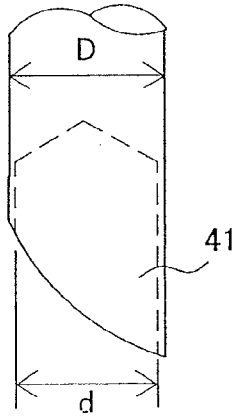

In the embodiment shown in FIG. 4, the punching shaft 42 is positioned between the upper frame 31*a* and the lower frame 31*b*, and is provided with a cam projection 37. The punching shaft 42 is arranged on the outer periphery with the cylindrical cam 45 and is provided with the V-shaped groove cam 45C to be engaged with the cam projection 37.

The shown cylindrical cam 45 is composed with the upper cam member 45A and the lower cam member 45B, the upper cam member 45A being divided into two upper and lower parts in the hole punching direction otherwise two left and right parts. A reason for dividing the cylindrical cam 45 into the two parts is because of making it easy to set up for accommodating the punching shafts 42 inside, and making it easy to form cam grooves in a periphery direction. Together with it, it makes easy to simplify a mechanism of fixing the cylindrical cam 45 to the device frame 30.

Following FIGS. 5(*a*)-5(*d*), explanation will be made to a structure of setting up the punching members 42 and the cylindrical cam 45. As showing in the same (a), the base frame 31 is integrally formed with an upper frame 31*a* and a lower frame 31*b*, defining the space Hf.

In the space Hf of the cylindrical cam 45, the upper cam member 45A and the lower cam member 45B are set vertically, and between these upper and lower cam members, the V-shaped groove cam 45C is formed.

Figure 6B:
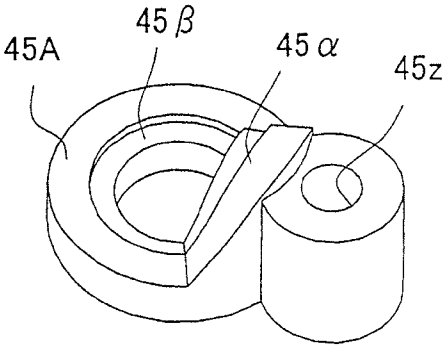
FIGS. 6(*a*)-6(*c*) are the structures of the cam members in the device of FIG. 1, where FIG. 6(*a*) shows a setting-up condition, FIG. 6(*b*) shows a perspective view of the upper cam member from the bottom side, and FIG. 6(*c*) is a perspective view of the lower cam member from the upper side.
Figure 6C:
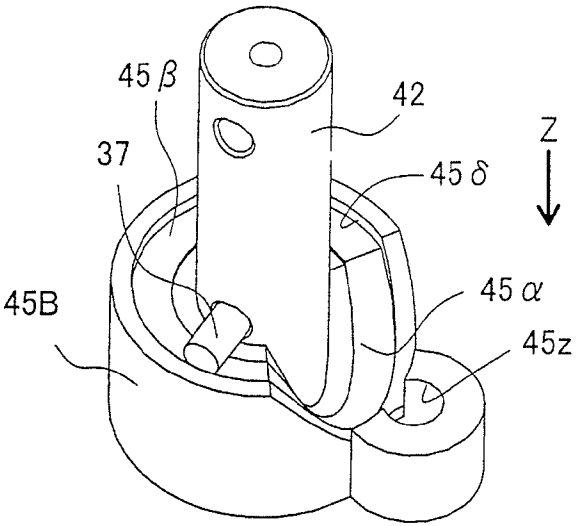
Figure 6A:
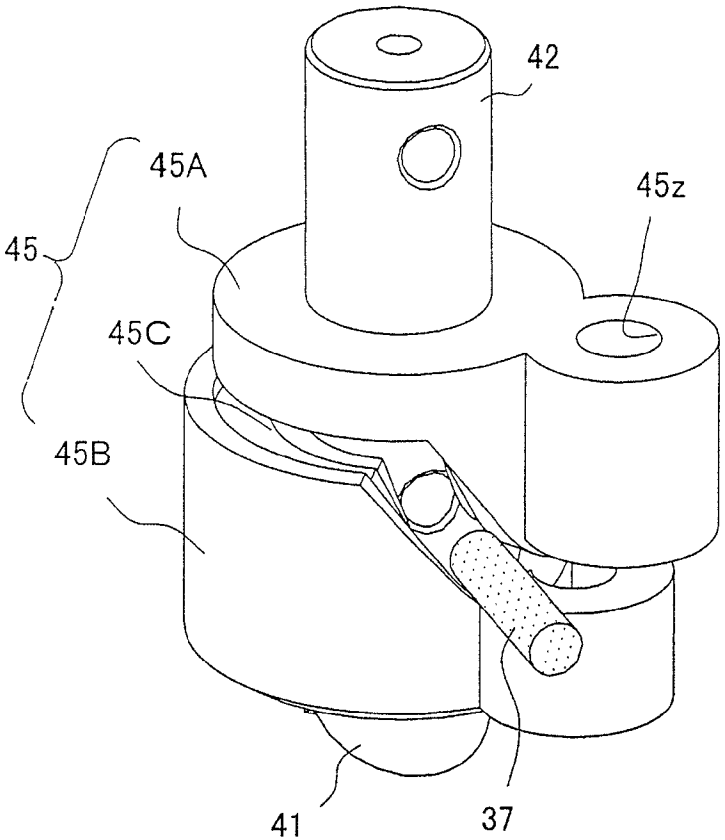

FIG. 6(*a*) shows the cylindrical cam 45 mounted with the punching shaft 42, and the cylindrical cam 45 is composed with the upper cam member 45A and the lower cam member 45B, and at a combined part (connected part) of both members, the V-shaped groove cam 45C is formed.

In the centers of these cam members, fitting holes are formed for playing the punching shaft 42. The fitting holes (not shown) of the punching members have inner diameters larger than the outer diameter of the punching shaft 42, and are formed with clearance for smoothly reciprocating the punching members in the hole punching direction.

The lower cam member 45B is, as shown in FIG. 3(*a*), supported (mounted) on a lower frame 31*b* via a ring shaped bush 31*v*, while the upper cam member 45A is supported (pressed) by an upper frame 31*a*.

If forming the bush 31*v* with an elastic material as a rubber, the lower cam member 45B, the cam projection 37 and the upper cam member 45A are laminated upward in this order, and are secured under such a condition of the cylindrical cam 45 being united between the lower frame 31*b* and the upper frame 31*a* owing to elasticity of the bush 31*v*.

Together with this, the upper cam member 45A and the lower cam member 45B are formed with penetration holes 45*z* of an engaging pin 45P at a position different from the mounting hole for inserting the punching shaft 42.

Accordingly, the upper and lower cam members 45A, 45B are combined up and down in the direction of the punching shaft (hole punching direction; Z direction), and the punching shaft 42 of each punching member is mounted, and an engaging pin 45P is inserted in the penetrating hole 45*z* formed in a position different from the mounting hole of the punching shaft 42, and this engaging pin 45P is penetrated in the upper frame 31*a* and the lower frame 31*b* (enough even if any one of the upper and lower frames is sufficient).

Thus, the cylindrical cam 45 is divided up and down into two and is held to the opposing wall faces of the upper frame 31*a* and the lower frame 31*b* having the interval Hf, and at the combined faces of the upper cam member 45A and the lower cam member 45B, the V-shaped groove cam 45C is formed.

The cylindrical cam 45 divided up and down is elastically supported in the interval Hf between the upper frame 31*a* and lower frame 31*b* by a bush 31*v* such as a rubber.

This invention is characterized by disposing the cylindrical cam 45 following the periphery of each punching shaft 42, securing the cylindrical cam 45 to the device frame 30, dividing the cylindrical cam 45 in upper and lower directions to form the V-shaped groove cam 45C at the upper and lower combining face (connecting face), and acting an elastic material such as the bush 31*v* to the punching shaft 42.

By dividing the cylindrical cam 45 into the two upper and lower parts, a making process of each cam member is made easy. By forming the cam faces on the upper and lower boundaries, processing precision of the V-shaped groove cam 45C can be obtained.

By furnishing the elastic members (such as rubber bush or rubber spacer) having elasticity in the hole punching direction to the upper and lower divided cylindrical cam 45, the elasticity is effected to avoid rattling of the punching shaft 42.

In this invention, explanation has been made to such a case that the bush 31*v* is disposed between the lower frame 31*b* and the lower cam member 45B, and it is also sufficient that the bush 31*v* is placed between the upper frame 31*a* and the upper cam member 45A, otherwise it may be also arranged as an elastic spacer at the connecting faces of the upper and lower cam members.

Further, the bush 31*v* is enough if it is an elastic member effecting elastic force in the hole punching direction such as a rubber spacer or a coil spring.

In the illustrated device, the cam projection 37 and the V-shaped groove cam 45C furnished on the punching shaft 42 contact as sliding, and the punching shaft 42 moves vertically along the V-shaped groove cam 45C in the hole punching Z direction.

At this time, as shown in FIG. 6(*c*), a step 45δ is formed in the cam face contacting the cam projection 37 for reducing sliding friction.

Next reference will be made to shapes of the V-shaped groove cam 45C of causing each of the punching members 40 to punch holes. As mentioned above, the shown embodiment shows switching between 2 hole-4 hole punching, and the punching members 40 are divided into a first group 40A (40*b*, 40*c*; 2 holes punching) and a second group 40B (40*a*, 40*b*, 40*c*, 40*d*; 4 holes punching).

The cylindrical cam 45 is disposed around the outer periphery of each of the punching shafts 42, and has the fitting hole of an inner diameter larger than the outer diameter D of the punching shaft. The fitting hole of the cylindrical cam 45 and the punching shaft 42 are not necessary to fit closely, but idly play within the fitting hole to such an extent that the punching shaft 42 can perform rotation and reciprocation in the hole punching direction.

The inside periphery of the fitting hole is formed with the V-shaped groove cam 450 engaging with the cam projection 37 projecting from the punching shaft 42. The V-shaped groove cam 45C is almost V-shaped (U-shaped or wave shaped) and has a V-cam face 45α and a horizontal-cam face 45β sloping to the hole punching direction (Z-direction in FIG. 6(*c*)).

Figure 7A:
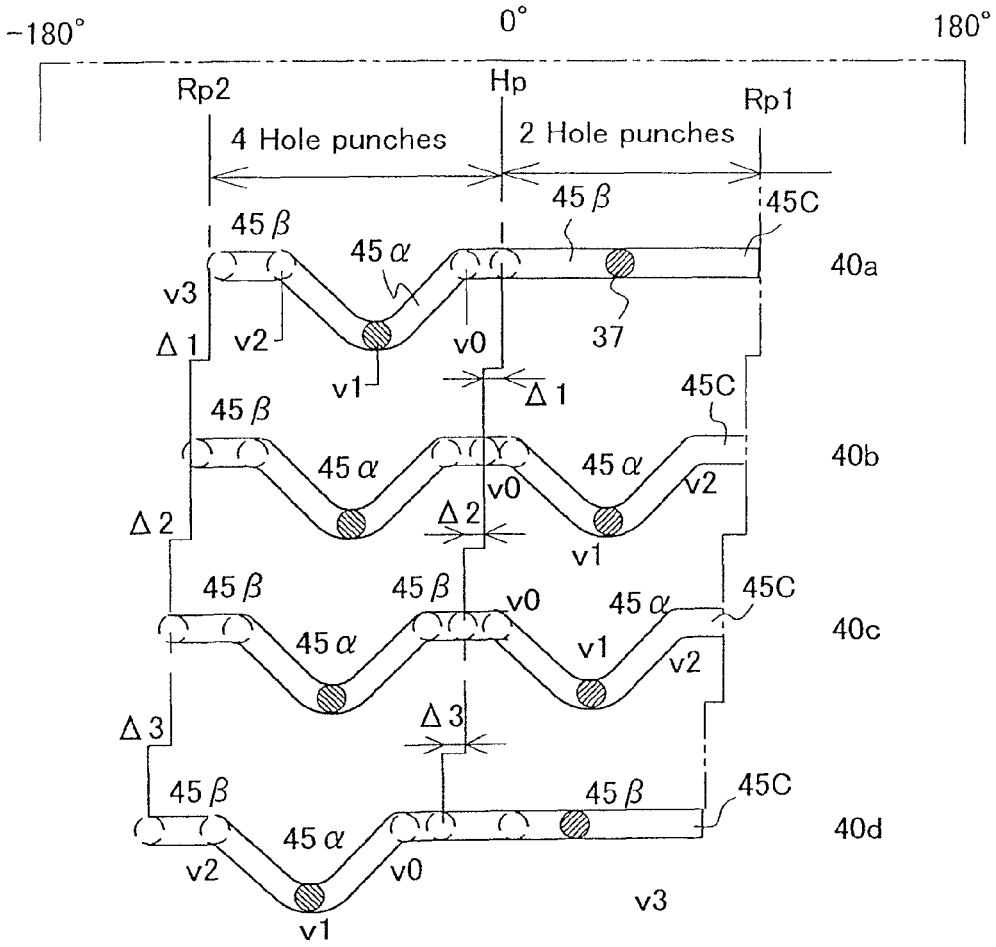
FIG. 7(*a*) shows explanatory views of developing the cam grooves, and FIG. 7(*b*) is an explanatory view of rotational strokes of the driving rotation shaft.
Figure 7B:
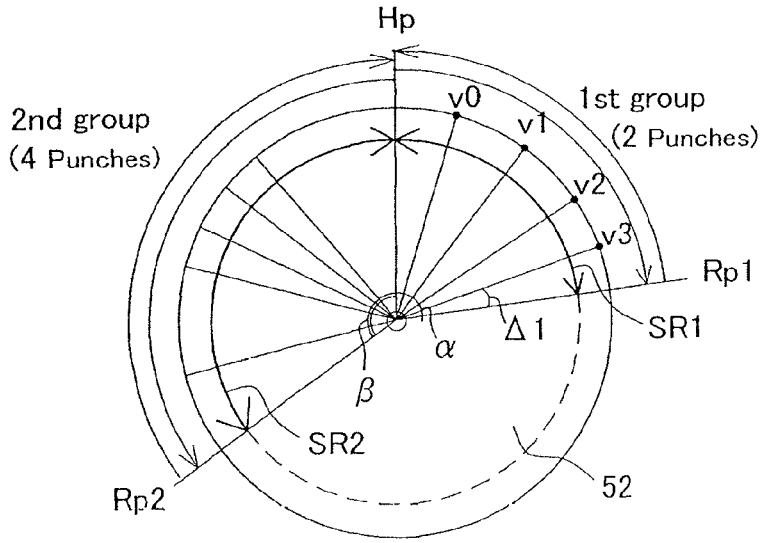

As shown in FIG. 7(*a*), the V-shaped groove cams (V-cam face 45α ) are provided in the two places in the cam grooves of the 2nd punching member 40*b* and the 3rd punching member 40*c*, while the V-shaped groove cams are provided in the one place in the cam grooves of the 1st punching member 40*b* and the 4th punching member 40*c*.

When the punching shaft 42 rotates following the V-shaped groove cam 45C, the 1st group of the punching members 40A reciprocates in two positions, while the 2nd group of the punching members 40B reciprocates in one position between the waiting position Wp of the upper dead point and the hole punching position Ap of the lower dead point.

For example, if rotating, 180 degrees from a predetermined standard position (e.g., 0 degree), each of the receiving gears 44 engaging with the punching shaft 42 by a later mentioned drive motor M, the 1st group of the punching members 40A (40*b*, 40*c*) move from the waiting position Wp to the hole punching position Ap, and return in succession to the waiting position Wp. Then, the sheets are made two holes.

In the angular range of 0 to 180 degrees, since the V-shaped groove cam 45C engaging with the cam projections of the 2nd group of the punching members 40B (40*a*, 40*d*), is formed with the horizontal-cam face 45β, the 2nd group of the punching members 40B (40*a*, 40*d*) is held in the waiting position Wp.

Similarly, if rotating, e.g., from 180 to 360 degrees, each of the receiving gears 44, the 2nd group of the punching members 40B (all of the punching members in the illustrated embodiment) move from the waiting position Wp to the hole punching position Ap, and return in succession to the waiting position Wp. Then, the sheets are made four holes.

In short, with respect to all of the punching members forming the 2nd group 40B, the cam grooves are all formed to be the V-cam face 45α in the range from 180 to 360 degrees.

[The Angular Position of Cam Engaging Portion and Gear Engaging Portion]

In this embodiment, when arranging a receiving gear 44 and cam means 45 to each punching member 40, the position relationship between the gear engaging member Eg and the cam engaging portion Ec is characterized as follows.

First, as shown in FIG. 1, a plurality of punching members 40 arranged linearly and a driving rotating shaft 52 are arranged in the orthogonal direction.

As shown in FIG. 3(*a*) to FIG. 5(*d*), each of the punching members 40 is provided with the receiving gear 44 engaging with a drive gear 55 disposed on driving rotation shaft 52. The receiving gear 44 and drive gear 55 are structured by the bevel gear, and transfer the rotational movement from the rotation of the driving motor M to each of the punching members 40.

The receiving gear 44 is loosely fitted into rod portion 42 of each of the punching members 40, and the rotation of the gear is transmitted to the rod member 42 with the penetrating pin 43. Each of the punching members 40 is vertically moving in the punching direction without restraint (movement regulation) by the receiving gear 44. For this purpose, each of the receiving gears 44 is provided with an elongated groove 47 for allowing the pin 43 to move vertically.

Also, in each punching member 40 shown in FIGS. 3(*a*), 3(*b*) and FIG. 4, cam means (cylindrical cam) converting a rotating movement to a punching direction movement is arranged with respect to the device frame 30 (upper portion frame 31*a*).

The cam means 45 as shown in the figure is constructed of a V-shaped groove cam 45C formed integrally with each of the punching members 40 and a cam pin 37(cam follower) fixed to the punching member.

In such structure, each of the punching members 40 punches a predetermined number of file holes on the sheet by the operation to rotatingly move from the top dead center to the bottom dead center.

Figure 12:
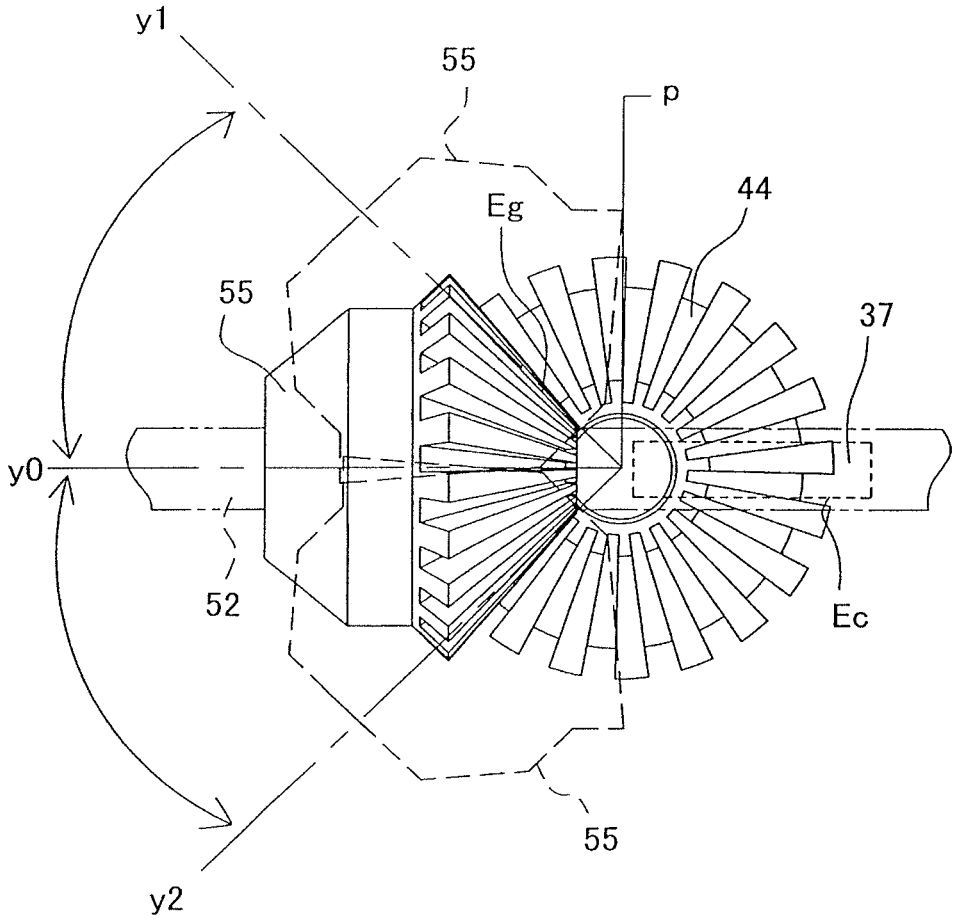
FIG. 12 is an explanatory view showing the relation of the angular position between a cam engaging portion and a gear engaging portion of each of the punching members of a device in FIG. 1.

Therefore, as shown in FIG. 4 and FIGS. 12(*a*)-12(*c*), the gear engaging portion Eg between the receiving gear 44 and the drive gear 55, and the cam engaging portion Ec between the groove cam 45C and the cam pin 37, are positioned at an angular position (shown as p-y0 direction) facing 180 degrees relative to the center of rotating axis of each of the punching members (shown as p), or within a predetermined angular range ±η (shown as p-y1 direction; p-y2 direction).

If a reaction force F acts from the cam pin 37 when the angular range (the angular difference between the cam engaging portion and the gear engaging portion) is ±η (η=45 degrees), the axis portion of each of the punching members warps as if inclining to lean forward.

During this time, the cam engaging portion Ec and the gear engaging portion Eg are set in the range of ±45 degrees, so backlash between teeth tips are obtained and the rotation of the driving and receiving gears will not be interfered (locking).

Next, in accordance with FIGS. 7(*a*) and 7(*b*), the cam mechanism will be explained. FIG. 7(*a*) is developing views showing shapes of the V-shaped groove cam 45C formed in the perimeters (inner and outer perimeters) of the cylindrical cam 45. FIG. 7(*b*) is an explanatory view showing rotating strokes of the driving rotation shaft 52.

As having above mentioned, the plural punching members 40 are disposed with the cylindrical cams between each of the punching members 40 and each of the cylindrical cams 45.

These cylindrical cams 45 are furnished with the V-shaped groove cams 45C. The V-shaped groove cam 45C changes motion in a manner of moving the punching member 40 in the hole punching direction at the same time with rotation. Together with it, by presence or absence of the V-shaped groove cam 45C, the punching member 40 is made choose to execute or not the punching motion.

In the following, the relation between the V-shaped groove cam 45C and the driving rotation shaft 52 will be explained with reference to FIG. 7(*b*).

By rotation of the driving rotation shaft 52, each of the punching members 40 rotates, and if the rotating direction of the driving rotation shaft 52 is reversely changed, the rotating direction of the punching member 40 is also changed.

The driving rotation shaft 52 reciprocates in the normal direction (α angle) and in the reverse direction (β angle) within a predetermined rotation range by a later mentioned motor control means 64.

The driving rotation shaft 52 reciprocally rotates at a first hole punching stroke SR1 between a predetermined standard point Hp and a first return position Rp1 as well as at a second hole punching stroke SR2 between the standard point Hp and a second return position Rp2.

At this time, SR1=(Hp−Rp1)=α angle, and SR2=(Hp−Rp2)=β angle.

It is determined that the first hole punching stroke SR1 punches 2 holes in the sheets, and the second hole punching stroke SR2 punches 4 holes in the same. In this determination, it is also possible that the former punches 2 holes, and the latter punches 3 holes.

In the shown device, at a border of the standard point Hp, the first punching hole stroke SR1 is formed in the clockwise direction, while the second punching hole stroke SR2 is formed in the counterclockwise direction.

Explanation will be made to the first punching hole stroke SR1, and since in the second punching hole stroke SR1, the same motion is also carried out, explanation will be omitted.

(Motion of Punching 2 Holes by the 1st Hole Punching Stroke)

A later mentioned motor control means 64 rotates the driving rotation shaft 52 in the rotating direction (clockwise direction) designated in dependence on the punching hole number from the standard point Hp preset by the position sensor.

At this time, the first punching member 40*a* and the fourth punching member 40*d* rotate but do not vertically move (non-hole punching motion).

When the driving rotation shaft 52 rotates, the second punching member 40*b* and the third punching member 40*c* only rotate between the standard point Hp and a shown V0 (Hp-V0) and do not move in the punching direction.

Subsequently, each of the punching members gradually goes down concurrently with rotation along an oblique cam face (V-cam face) 45α between V0-V1 by rotation of the driving rotation shaft 52. At V1 when the punching members 40*b*, 40*c* most go down, the hole punching motion to the sheets ends.

The punching members 40*b*, 40*c* rotate from V1 to V2 along the oblique cam face (V-cam face) 45α by rotation of the driving rotation shaft 52 in the same direction, and concurrently go up (returning motion).

When the punching members 40*b*, 40*c* return to the upper dead point, each of the punching members rotates only in the rotating direction and is held there with respect to the hole punching direction.

When the driving rotation shaft 52 is rotated clockwise, the first and fourth punching members 40*a*, 40*d* are maintained at the upper dead points, and the second, third punching members 40*b*, 40*c* move from the upper dead points to the lower dead points, and return to the upper dead points. At this time, the second, third punching members 40*b*, 40*c* punch holes in the sheets.

Between the second, third punching members 40*b* and 40*c*, delay in time (phase difference Δ2) has been formed, and by this delay in motion, shearing loads of the second, third punching members 40*b*, 40*c* are lightened.

For this case, a later mentioned motor control means 64 rotates the driving rotation shaft 52 clockwise at a predetermined angle α from the standard point Hp, and executes the first hole punching stroke SR1. The driving rotation shaft 52 moves from the standard point Hp to the first return position Rp1. Under this condition, the 2 hole punching is performed in the sheets set on the sheet placing frame 35.

The motor control means 64 rotates counterclockwise the driving rotation shaft 52 and inverts from the first return position Rp1 to the standard point Hp. Then, after the V-groove cam 45C and the cam projection 37 rotate and move from V3 position to V2 position, the punching members 40*b*, 40*c* go down from V2 to V1 along the oblique cam face (V-cam face), and this time, punching motion is carried out.

By continuous rotation of the driving rotation shaft 52, each of the punching members 40 goes upward to the upper dead point and returns to the standard point Hp.

The punching member 40 punches the anticipating sheets, for example, in the clockwise rotation, and punches the following sheets in the counterclockwise rotation.

Therefore, punched debris is collected in the debris box by converting in terms of the right or left directions.

The present invention differs the stroke lengths of the first and second hole punching strokes SR1 and SR2, because the hole punching loads are different depending on the punching motion of the more punching number and that of the less punching number.

Therefore, the first hole punching stroke SR1 of the less punching load is set to be shorter than the second hole punching stroke SR2 of the more punching load. Thus, the shown angles α and β are set to be the angle α<the angle β.

[Gear Transmission Mechanism]

As having mentioned above, the drive gears 55 secured to the driving rotation shaft 52 are geared with the receiving gears 44. As shown in FIG. 4, the receiving gear 44 is rotatably supported by the upper frame 31*a*. The bottom 44*x* (the lower end in the hole punching direction) of the receiving gear 44 is slidably supported on the upper face of the upper frame 31*a*, and the upper face 44*y* (teeth shaped face) of the receiving gear 44 is supported by the drive gear 55.

As shown in FIG. 4, the receiving gear 44 is adjustable at the height position by adjusting an attaching position to the driving rotation shaft 52 of the drive gear 55, and its bottom 44*x* is supported by the upper face wall of the upper frame 31*a*.

Accordingly, the receiving gear 44 is set up without causing rattling in the hole punching direction, irrespective of the processing precision of drive/receiving gears and attaching positional slippage.

Figure 8B:
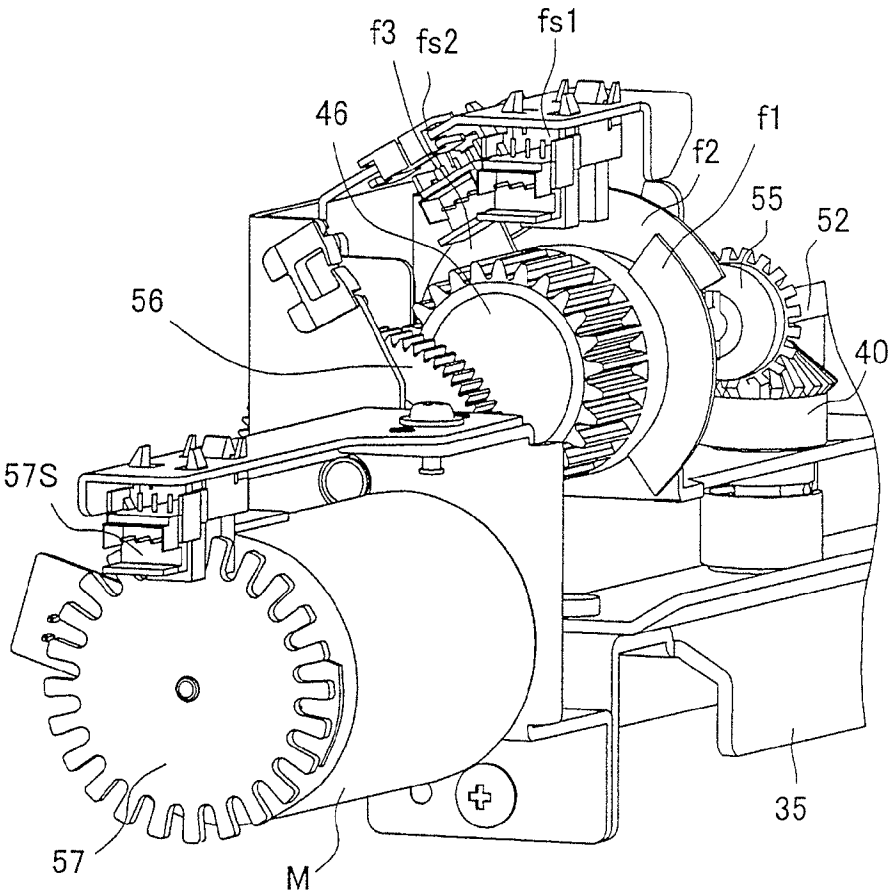
FIGS. 8(*a*), 8(*b*) are explanatory views of the drive mechanism in the device of FIG. 1, where FIG. 8(*a*) is the explanatory view of an angle position detecting mechanism of a driving rotation shaft, and FIG. 8(*b*) is the perspective explanatory view of the drive motor and the transmission mechanism.
Figure 8A:
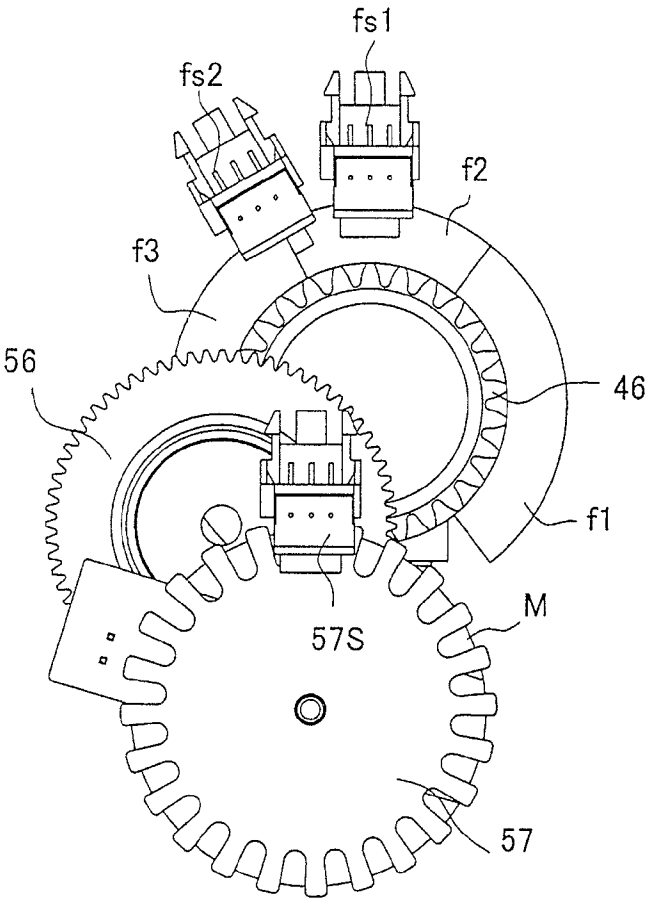
Figure 9B:
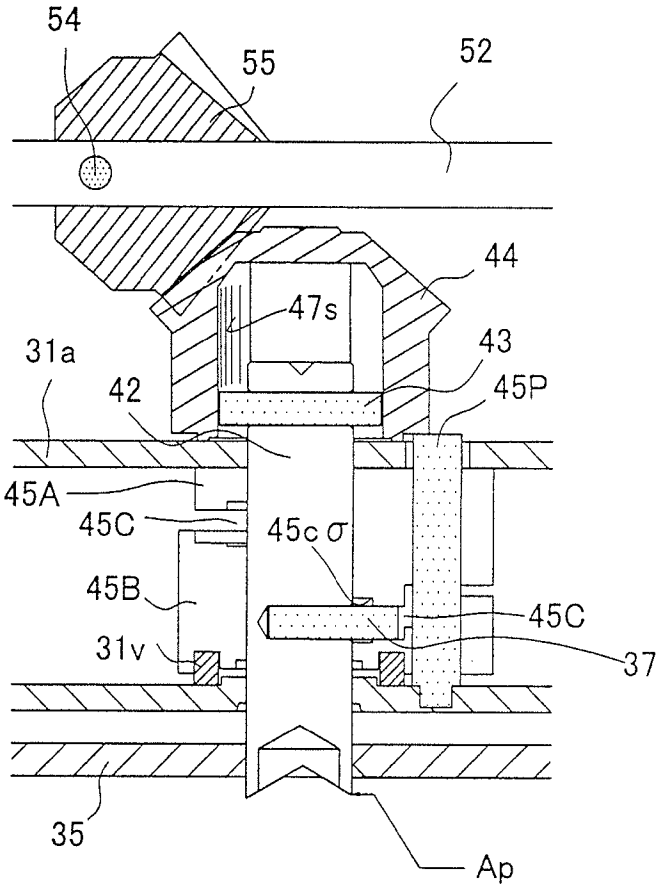
FIGS. 9(*a*), 9(*b*) are explanatory views of operating conditions in the device of FIG. 1, where FIG. 9(*a*) shows the punching member waiting at an upper dead point, and FIG. 9(*b*) shows the punching member punching holes at a lower dead point.
Figure 9A:
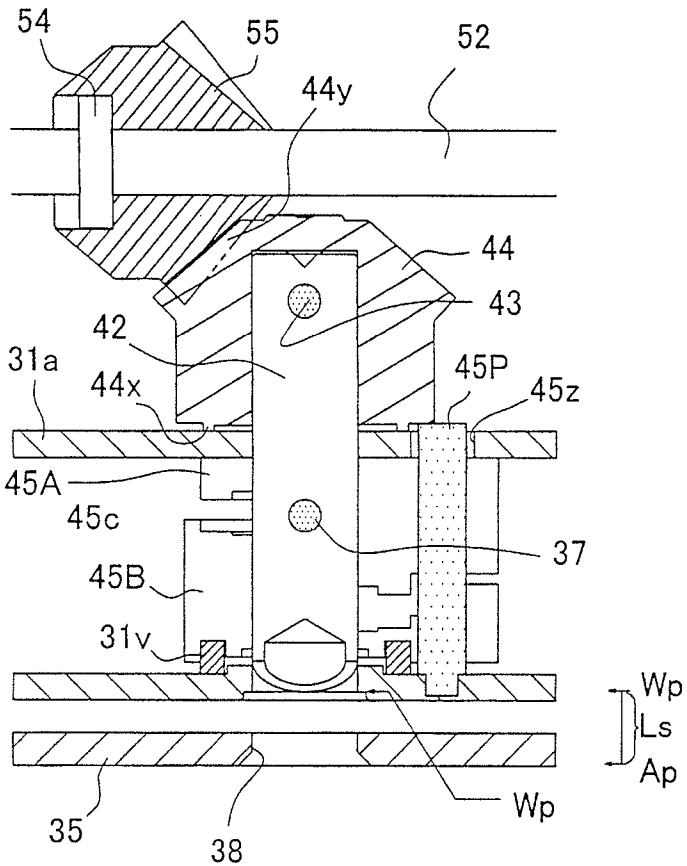
Figure 10:
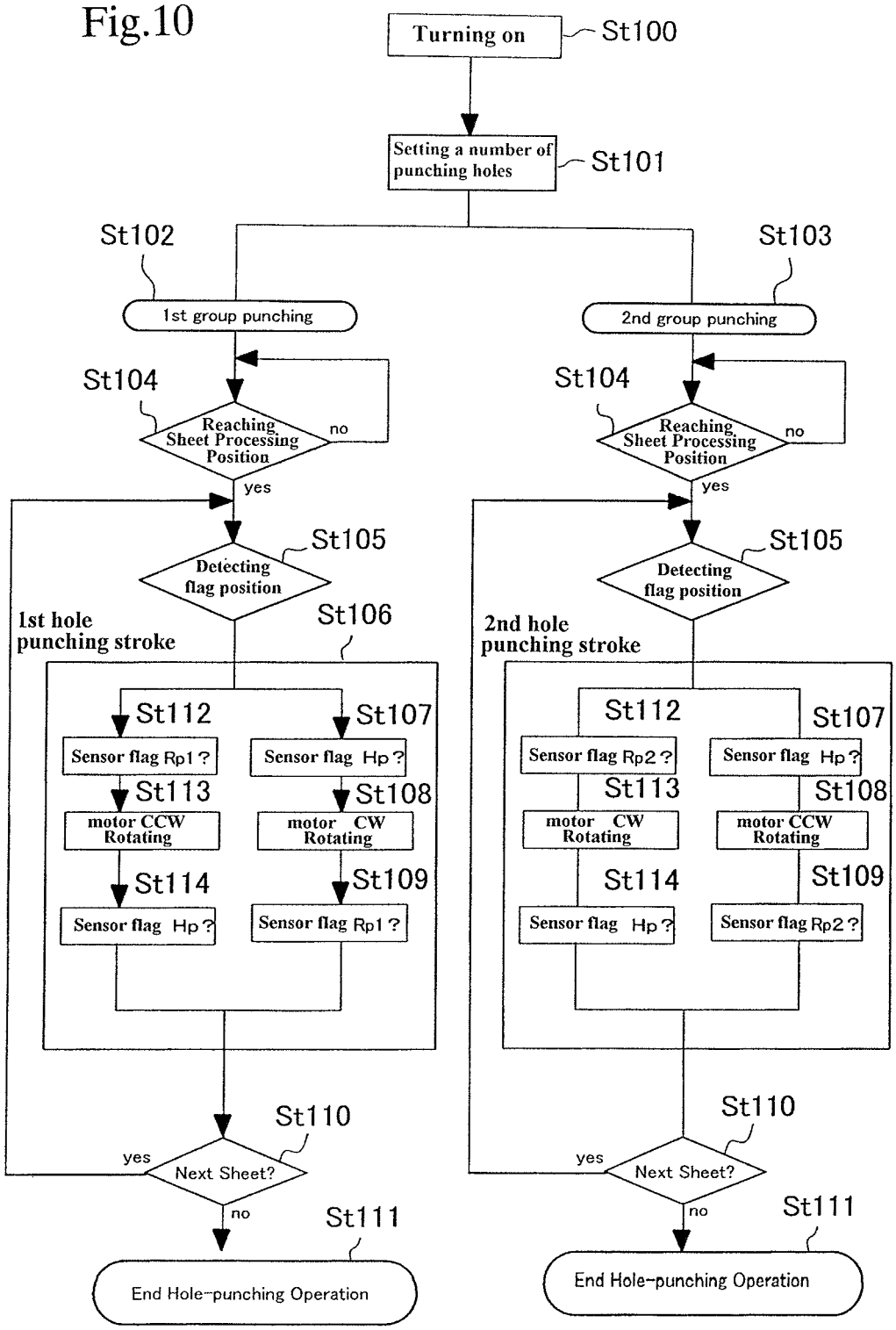
FIG. 10 is a flow chart showing controls of the hole punching device in the device of FIG. 1.

Next, the drive mechanism will be explained, referring to FIG. 8. At the left side frame 48*a* of the device frame, the drive motor M is provided, driving is transmitted from the motor rotating shaft to the transmission intermediate shaft 56 via a reduction gear 46, and is transmitted to the driving rotation shaft 52. Rotation speed of the driving rotation shaft 52 is determined by reduction gear ratio.

[Control of Rotation of Drive Motor]

The above mentioned motor rotating shaft is provided with an encoder 57 and an encoder sensor 57S. Rotational amount of the drive motor M is detected by detecting signal of the encoder sensor 57S.

The driving rotation shaft 52 is provided integrally with a 1st flag f1, 2nd flag f2, 3rd flag f3, and a 1st flag sensor fs1 and 2nd flag sensor fs2 are arranged to the device frame 30 for detecting each of flag positions. Accordingly, if the driving rotation shaft 52 rotates one-rotation, the flags arranged integrally on the rotating shaft also rotate one-rotation.

The 1st flag f1, 2nd flag f2 detect whether the driving rotation shaft 52 rotates in one direction from the standard position (for example, clockwise) or rotates in an opposite direction (counterclockwise).

If the 1st and 2nd flag sensors fs1, fs2 are both ON, the driving rotation shaft 52 positions at the standard point Hp (home position), and if the 1st flag sensor is ON and 2nd flag sensor is OFF, the driving rotation shaft 52 controls the position for the 1st group of the punching members 40A to punch hole.

If the 1st flag sensor is OFF and 2nd flag sensor is ON, the driving rotation shaft 52 controls the position such that the 2nd group of the punching members 40B causes to punch holes.

Next, the action of the above mentioned punching member will be explained, referring to FIGS. 7(*a*), 7(*b*). The motor control means 64 is structured to in advance determine whether for the 1st group of the punching members 40A (40*b*, 40*c*) to punch holes, or for the 2nd group of the punching members 40B (40*a* to 40*d*) to punch holes.

By the way, the driving rotation shaft 52 is controlled to position at the standard position (home position) when the device is at an initializing action.

Therefore, the motor control means 64 rotates the drive motor M in the normal direction when setting the 1st group of the punching members 40A, and rotates the drive motor M in the opposite direction when setting the 2nd group of the punching members 40B.

In short, when an operator selects the 2 hole punching, the driving rotation shaft 52 is rotated in the rotating direction where the 2 hole punching members 40*b*, 40*c* operate, and when selecting the 4 hole punching, the driving rotation shaft 52 is rotated in the rotating direction where the 4 hole punching members 40*a* to 40*d* operate.

[Hole Punching Flow]

In the above explained device structure, the hole punching operations of 2 or 4 holes are performed as follows.

When turning ON the power source of the device, the driving rotation shaft 52 is moved to the home position for initializing operation (St100). This moving judges whether or not a flag sensor is turned ON, and until the sensor becomes ON, the drive motor M is rotated.

Next, motor control means 64 determines a number of punching holes (St101). This is to determine to cause the punching member 40A of a first group to punch holes (St102), or to cause the punching member 40B of a second group to punch holes (St103).

Subsequently, the motor control means 64 detects whether or not the sheets reach an initial position by means of a not shown sheet sensor (St104). When the sheets are set at the initial position, the motor control means 64 distinguishes the flag position of the driving rotation shaft 52 (St105). This flag position is determined to be set at any one of the home position, the 1st return position Rp1 and the 2nd return position RP2, and is structured to count which position it is.

Then, when the motor control means 64 confirms the sensor flag positioning at the home position (St107), the motor control means 64 selects a first hole punching stroke SR1 of the first group punching member 40A, and rotates the drive motor M in CW direction from the standard point Hp (St108). Other operations are the same as those of the first hole punching operation, and explanations will be omitted.

The driving rotation shaft 52 is rotated clockwise to rotate the drive motor until the sensor flag positioning the standard point Hp reaches the first return position Rp1 (St109). This driving rotation of the drive motor M rotates at the pulse number predetermined when the sensor flag positions at the home position Hp, and at the same time, it operates an electric brake when the predetermined pulse passes, and is set such that the returning position of the sensor flag turns ON.

Then, the motor control means 64 detects whether or not a following sheet exists (St110). When the following sheet does not exist, it finishes the hole punching operation (Still), and when the following sheet exists, it discriminates the position of the sensor flag. When the sensor flag positions at the first return position Rp1 (St112), the motor control means 64 rotates counterclockwise (CCW) the drive motor M (St113), and rotates until the sensor flag returns the standard point Hp (St114).

Otherwise, when this position detection shows the sensor flag being at the standard point Hp, the motor control means 64 rotates the drive motor clockwise (CW), and rotates until the sensor flag comes to the first return position Rp1. The rotation control at this time of the drive motor M is the same as having above explained.

Thus, the rotating direction is reversed such that the precedent sheet is in the clockwise direction (CW), and the subsequent sheet is in the counterclockwise direction (CCW).

When selecting the second hole punching stroke SR2, the motor control means 64 rotates CCW (counterclockwise direction) the driving rotation shaft 52 from the standard point Hp, and returns at the second hole punching stroke SR2. The control of the drive motor M is the same as that of the punching stroke SR1.

At this time, the driving rotation shaft 52 reciprocates between the second return position Rp2 shown in FIG. 7(*b*) and the standard point Hp.

[Controlling Structure]

Figure 11:
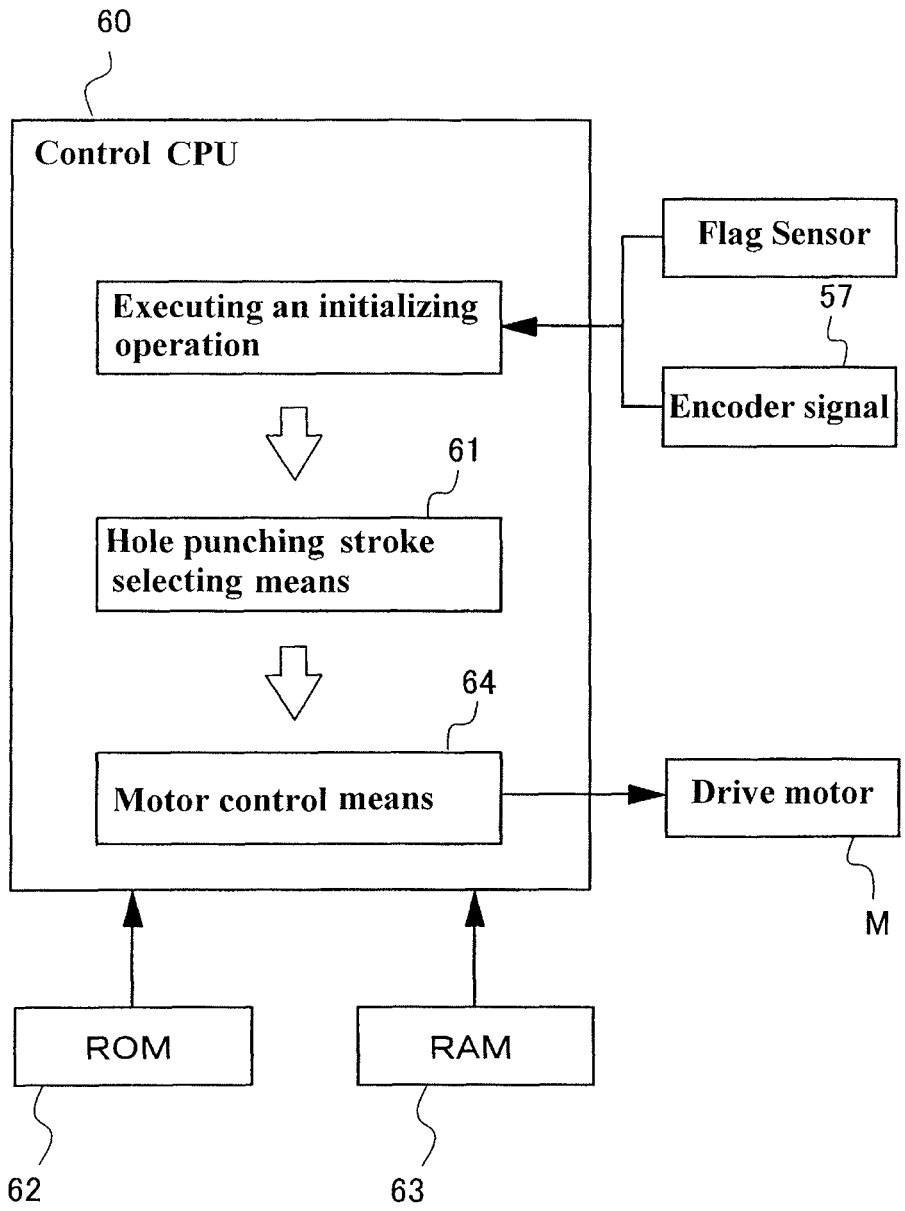
FIG. 11 is a block diagram showing the control structure in the device of FIG. 1.

FIG. 11 shows a controlling structure of the device of FIG. 1. The controlling structure is composed of, for example, a control CPU 60, and a hole punching stroke selecting means 61 is composed from a not shown control panel. The control CPU 60 executes an initializing operation and a hole punching operation in accordance with the program of ROM 62 and the control data of RAM 63.

The hole punching stroke selecting means 61 recognizes the hole punching number selected by an operator, and based on its result, a motor control means 64 controls the drive motor M.

To the control 60, a detecting signal of the flag sensor and a detecting signal of the encoder 57 are transmitted from an encoder sensor 57S. Besides, a detecting signal of a jam detecting means is sent.

[Explanation of Post-Treating Device]

Figure 13:
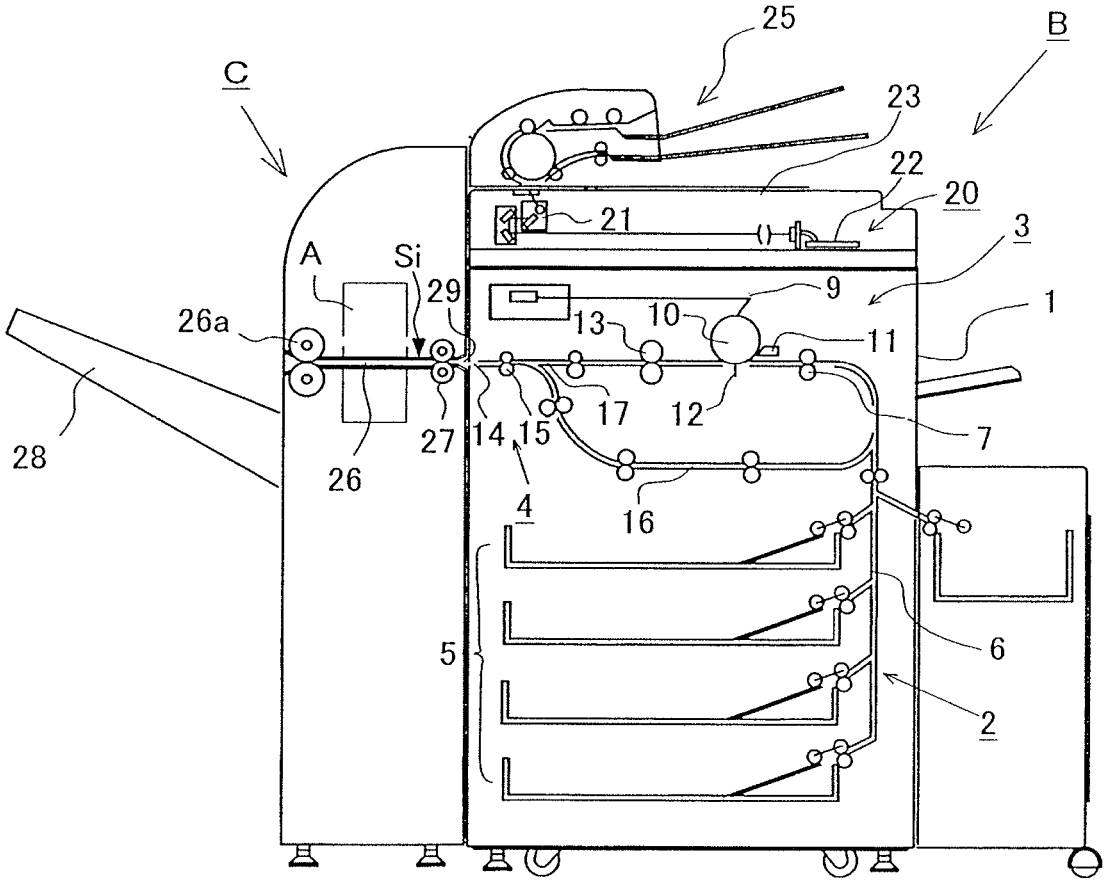
FIG. 13 shows an explanatory view of the whole structure of a post-treating device and an image forming system building-in paper sheets and the like of FIG. 1.

Next, the structure of a post-treating device C in an image forming device B relating to the present invention will be explained referring to FIG. 13. The image forming system shown in FIG. 8 is composed of the image forming device B of performing printings in succession on the sheets and the post-treating device C provided at a downstream side of the image forming device B.

The sheets formed with images in the image forming device B are performed with the hole punching treatment in the post-treating device C.

Firstly, the image forming device B may employ many kinds of structures such as a copier, printer or printing machine, and the illustrated device shows an electrostatic printing device. This image forming device B is built in a casing 1 with a sheet feeding part 2, a printing part 3, a sheet outlet 4, and a controlling part (not shown).

The sheet feeding part 2 is prepared with plural cassettes 5 in response to sheet sizes, and the sheets having sizes indicated by the controlling part are drawn out into a sheet feeding path 6. This sheet feeding path 6 has resist rollers 7 and feeds the sheets of justified front ends to the printing part 3 positioned at the downstream.

The printing part 3 has an electrostatic drum 10, and around the drum 10, there are displaced a printing head 9, a development unit 11, a transferring charge 12 and others. The printing head 9 is composed of, e.g., a laser photogenic organ, and an electrostatic latent image is formed on the electrostatic drum 10. This latent image is adhered with a toner ink by a development unit 11, and printed on the sheets by a transfer charger 12.

These printed sheets are fixed by a fixing unit 13 and transferred into a discharging path 17. At the sheet outlet 4, there are a sheet discharging mouth 14 formed in the casing 1 and sheet discharging rollers 15.

Incidentally, numeral 16 represents a circulating path, which turns reversely the printed sheets from the discharging path 17 in a switch-back path, and after then sends again them to the resist rollers 7 for forming images on the reverse faces of the printed sheets. The printed sheets on one side or both sides are discharged by the discharging rollers 15 from the sheet outlet 14.

Numeral 20 represents a scanner unit of optically reading images on a document image to be printed by the printing head 9. The structure is, as generally known, made of a platen 23 for placing and setting the document sheets thereon, a carriage 21 for scanning the document image along the platen 23 and an optically reading means (for example, CCD device) 22 for photo-electrically converting an optical image from the carriage 21. The illustrated unit is furnished, on the platen 23, with an document feed device 25 automatically sending the document sheets to the platen.

The post-treating device C is connected to the sheet outlet 14 of the image forming device B. The post-treating device C is composed of a sheet transferring path 26, a punch unit A disposed to the sheet transferring path 26, and a sheet discharging stacker 28. The sheet transferring path 26 is provided with a registering means 27 at an upstream side of the punch unit A for registering the sheets at the rear ends.

The sheet transferring path 26 is arranged with reciprocally rotating rollers 26*a* for tossing the sheets from an inlet 29 to the registering means 27, and at the same time, the reciprocally rotating rollers 26*a* transfer the sheets from the punch unit A to the sheet discharging stacker 28. "Si" represents a sheet detecting sensor.

The punch unit A is composed of the device shown in FIG. 1 having been explained before.

The thus composed post-treating device C receives the printed sheets from the inlet 29 of the image forming device B, detects the sheets at the rear ends by the sheet detecting sensor Si, and reverses (shown counterclockwise direction) the reciprocally rotating rollers 26*a* at a timing of passing the rear ends of the sheets at the registering means 27. Then, the sheets are switched back and the sheets collide at the rear ends the registering means 27 and registered.

After having registered, the reciprocally rotating rollers 26*a* stop and hold the sheets at this position. Under this condition, the punch unit A drives the drive motor M to execute the above mentioned hole punching operation. After the hole punching operation, the reciprocally rotating rollers 26*a* is rotated clockwise by the ending signal from the position sensor to transfer the punched sheets to the sheet discharging stacker 28.

By the way, the post-treating device C is incorporated with a staple unit, a stamp unit, and other in response to a device specification, although they are not illustrated.

What is claimed is:

1. A sheet hole punching device comprising:

a plurality of punching members having first and second groups;

a device frame bearing-supporting the plurality of punching members to vertically move the punching members in a hole punching direction, the plurality of punching members being arranged linearly on the device frame;

a driving rotation shaft disposed in a direction crossing the punching members;

a driving motor reciprocally rotating the driving rotation shaft within a predetermined angular range;

a gear mechanism transmitting a rotation of the driving rotation shaft as a rotational movement to each of the punching members;

cam mechanisms converting the rotational movement of each of the punching members into a vertical movement in the punching direction at a same time of the rotation; and a motor control device to control the drive motor, wherein the gearing mechanism includes drive gears fixed on the drive rotational shaft, and receiving gears disposed on the punching members to engage with the drive gears, each receiving gear engaging each punching member so that the punching member slides in the punching direction and rotates, and each cam mechanism includes a cam follower formed integrally with the punching member, and a cylindrical cam fixed to the device frame, the cylindrical cam having a V-shaped groove cam to reciprocate each punching member between an upper dead point and a lower dead point with respect to the rotation within the predetermined angular range.

2. A hold punching device according to claim 1, wherein the motor control device is arranged to continuously punch holes by forward and reverse rotations of the driving rotation shaft, the punching members are rotated in one direction to punch holes in a sheet, and subsequently rotated in a reverse direction to punch holes in a following sheet, and the first group of the punching members punches holes in the sheet by rotating the driving rotation shaft in one direction, and the second group of punching members punches holes by the rotation in the reverse direction of the driving rotation shaft.

3. A sheet hole punching device according to claim 1, wherein the device frame comprises an upper frame and a lower frame with a predetermined interval, each of the punching members is slidably supported between the upper frame and the lower frame, the cylindrical cam is disposed between the upper frame and the lower frame, the driving rotation shaft is spaced apart from the upper frame and is positioned above the upper frame, and the receiving gear is disposed between the driving rotation shaft and the upper frame.

4. A sheet hole punching device according to claim 1, wherein each of the drive gears and each of the receiving gears comprise bevel gears engaging with each other, each of the drive gears is fixed integrally on the drive rotating shaft rotatably supported to the device frame, and each of the receiving gears is held between the drive gear and the upper frame.

5. A sheet hole punching device according to claim 1, wherein the driving rotation shaft is set with a first hole punching stroke for reciprocating in a first rotation angular range, and with a second punching stroke for reciprocating in a different second rotation angular range, and the first hole punching stroke and the second hole punching stroke are set within ranges where the first and second hole punching strokes rotate in opposite directions each other at predetermined standard points in the driving rotation shaft.

6. A sheet hole punching device according to claim 5, wherein the first hole punching stroke and the second hole punching stroke have different stroke lengths in response to number of holes to be punched, and the length of the stroke with more hole punching numbers is longer than the length of the stroke with less hole punching numbers.

7. A sheet hole punching device according to claim 1, wherein a gear engaging portion between each of the receiving gears and each of the drive gears, and a cam engaging portion between the groove cam and the cam follower, are positioned at an angular position facing relative to a center of a rotating axis of each of the punching members or within an angle range of 45 degrees.

* * * * *